United States Patent [19]

Bahry et al.

[11] 3,991,595

[45] Nov. 16, 1976

[54] LOCKING ARRANGEMENT FOR DOORS AND THE LIKE

[76] Inventors: Abraham Bahry; Moshe Dolev, both of 41 Geulim St., Holon, Israel

[22] Filed: Sept. 30, 1974

[21] Appl. No.: 510,405

[52] U.S. Cl. ..... 70/120; 70/83; 70/116; 292/32; 292/36; 292/39; 292/139; 292/142; 292/DIG. 36

[51] Int. Cl.[2] ..... E05B 63/14; E05C 1/06; E05C 9/06; E05C 9/16

[58] Field of Search ..... 292/32, 36, 39, 139, 292/142, 167, 172, DIG. 36; 70/83, 116, 118, 120

[56] References Cited

UNITED STATES PATENTS

| | | | |
|---|---|---|---|
| 446,789 | 2/1891 | Reed | 292/36 |
| 768,418 | 8/1904 | Adams | 292/36 |
| 788,952 | 5/1905 | Schwegler | 292/36 |
| 1,018,475 | 2/1912 | Bedell | 292/39 |
| 1,317,820 | 10/1919 | Phillips | 292/36 |
| 1,380,117 | 5/1921 | Soliani | 292/39 |
| 3,776,581 | 12/1973 | Ross | 292/39 |

FOREIGN PATENTS OR APPLICATIONS

| | | | |
|---|---|---|---|
| 529,250 | 6/1955 | Italy | 70/120 |
| 41,280 | 8/1937 | Netherlands | 292/36 |
| 6,832 | 5/1935 | United Kingdom | 70/118 |

*Primary Examiner*—P. R. Gilliam
*Assistant Examiner*—Carl F. Pietruszka
*Attorney, Agent, or Firm*—Alter and Weiss

[57] ABSTRACT

A locking arrangement for doors and the like comprising a key-operated cylinder lock mounted in the door or the like and extending at both surfaces, to be operated by a key, an actuating gear keyed to the cylinder of the lock, which by means of a gear wheel and curved links is adapted to move at least one elongated bolt linearly.

7 Claims, 3 Drawing Figures

LOCKING ARRANGEMENT FOR DOORS AND THE LIKE

The present invention relates to locking arrangements for doors, windows and the like in which at least one elongated locking bolt is adapted to be extended or retracted into the locking or the unlocked position by means of a cylindrical lock provided in the central region of the door.

Many locking arrangements of this type are known. In general a cam, pawl, or toothed wheel is mounted at the inner end of the cylindrical lock and is adapted by means of a rack or cam to cause a linear movement of one or more bolts. These mechanisms are generally of very complicated construction, for example U.S. Pat. No. 1,041,147 and British Pat. No. 669,066. These mechanisms have the disadvantage that they can be operated from one side of the door only.

Other locking means, operating elongated bolts from the center of a door by means of a hangle or the like are also known. The construction of the handle is such that it can actuate the bolt or bolts in the door center. In such a case, a lock operable by a key may be provided to prevent the operation of that handle. However, this type of arrangement is also of complicated construction and does not provide a fool-proof lock.

Accordingly, an object of the present invention is to provide a locking arrangement for doors and the like which is of simple construction, is adapted to be operated by a known cylindrical lock, and assures an absolutely foolproof locking position.

In keepting with an aspect of this invention, these objects are accomplished by a locking arrangement for doors and the like comprising at least one elongated locking bolt adapted to be extended and retracted by a key-operable cylinder lock mounted in the central region of the door or the like. The key operable cylinder lock is mounted to extend at both sides of the door for operation by the key with an actuating gear keyed on the cylinder of the lock. A wheel is rotatably mounted in a fixed mounting surface for engagement with the gear, and pivotally carries one end of at least one curved link. The other end of the curved link is pivotally connected to the bolt and is guided for linear movement in the mounting surface.

In a preferred embodiment of the invention four locking bolts are actuated each by one said link, with each bolt extending from substantially the center of one of the edges of the door or the like.

The nature of a preferred embodiment will be understood best from a study of the attached drawing wherein.

Figure 1:
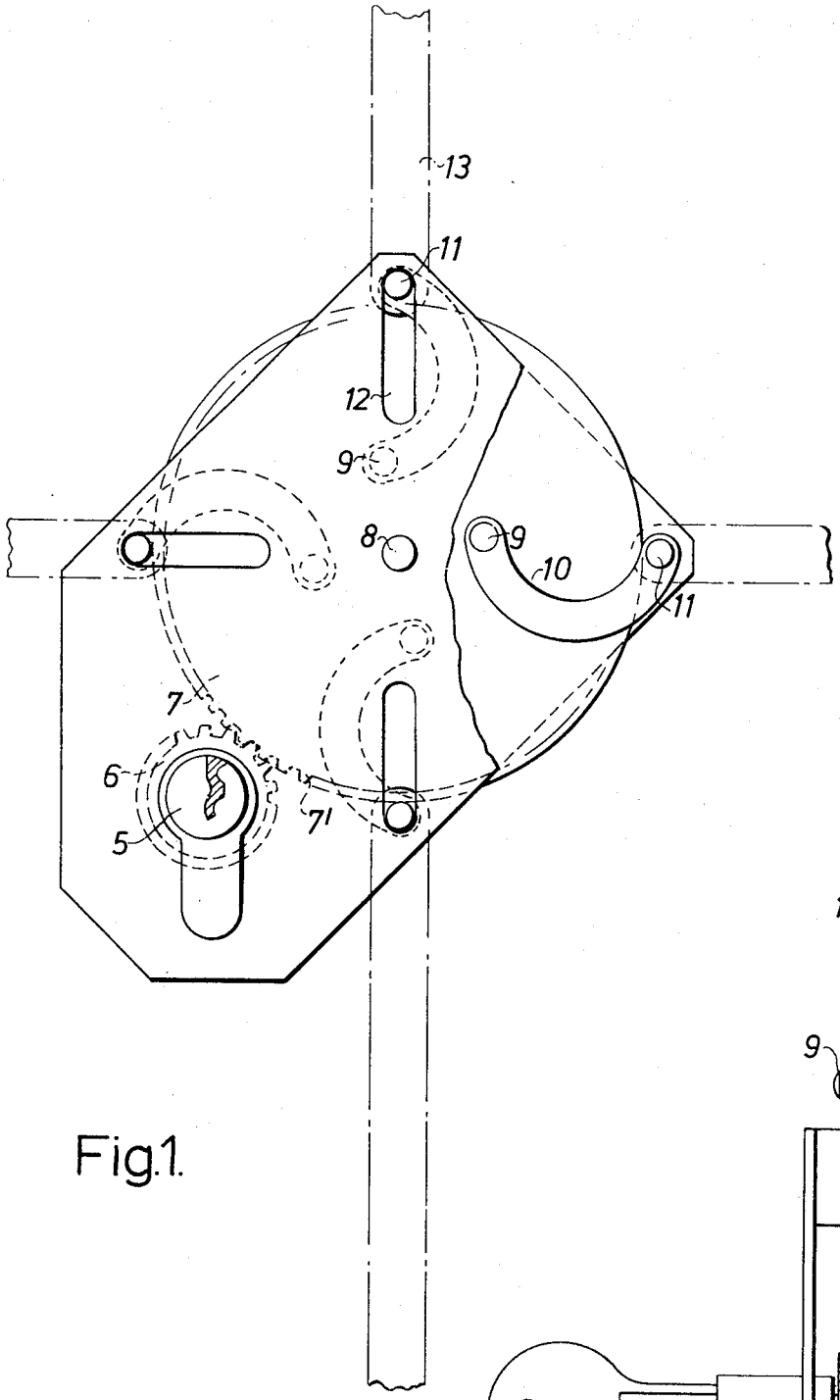
FIG. 1 is a front elevation, partly broken away, of the locking arrangement according to the present invention in the locking position.
Figure 2:
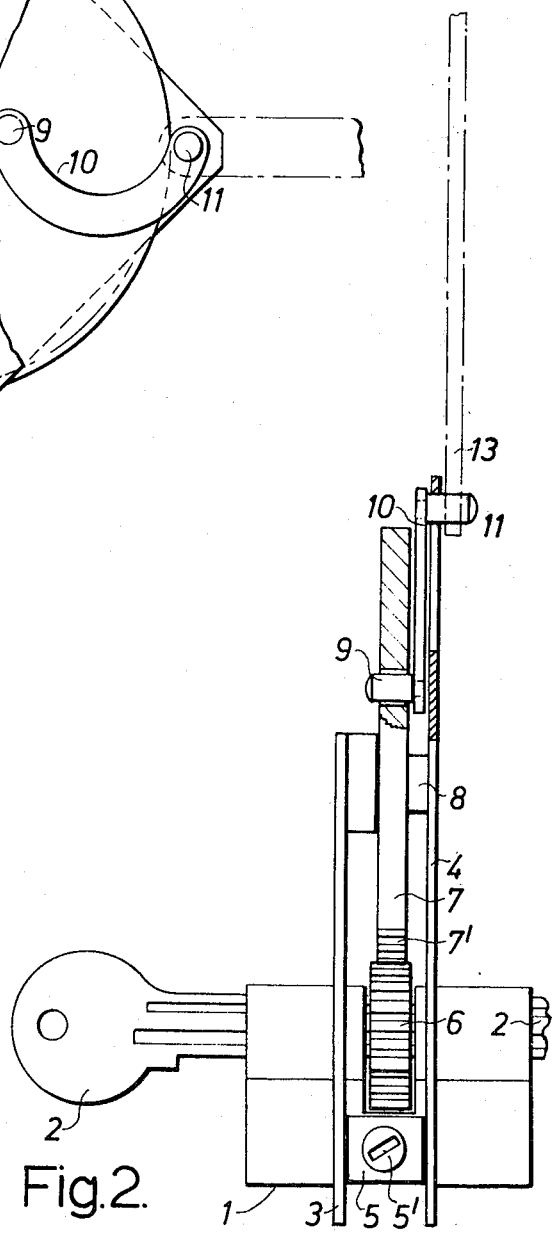
FIG. 2 is a side elevation view, partly broken away, of the inventive locking arrangement.
Figure 3:
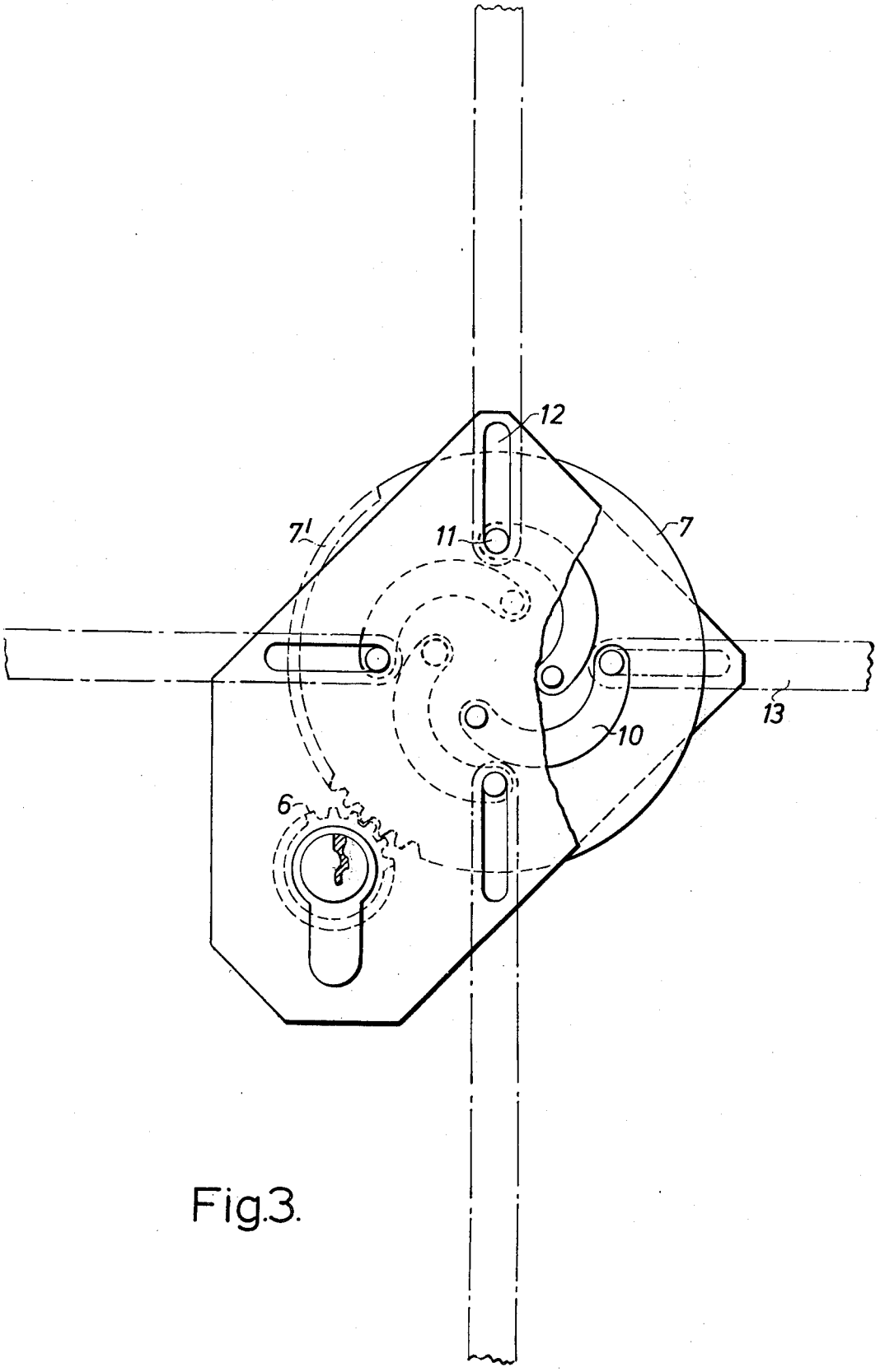
FIG. 3 is a front elevation view, as in FIG. 1, with the locking arrangement in the non-locking position.

A cylindrical lock 1 is mounted in the central region of a door (not shown) and is operable from either side by a key 2. The lock is mounted between two plates 3 and 4 and extends therefrom on either side. A plate 5 held to the lock by a screw 5′ prevents axial movement of the lock relative to the plates 3 and 4. The cylinder of said lock beteen plates 3 and 4 has keyed to it an actuating gear 6 which is in mesh with the toothed section 7′ of an operating wheel 7. The wheel 7 is turnably mounted on a sleeve 8 fixed between plates 3 and 4. The toothed section 7′ of wheel 7 is of predetermined arcuate length. Four gudgeon pins 9 extend through wheel 7 at equal angular positions and pivotally carry at the side adjacent plate 4 one end of a curved link 10. The other end of curved link 10 is pivotally attached to pin 11 which extends through an elongated slot 12 in plate 4. The slots 12 are diametrically aligned around sleeve 8 at 90° from each other. The lower end of four locking bolts indicated by reference numeral 13 are pivotally attached to pins 11.

The locking bolts 13 extend preferably in longitudinal bores made between the surface of a door. The other parts of the locking arrangement are housed in the door central region in a depression provided for the purpose.

In operation, as key 2 turns the cylinder of lock 1, gear wheel 6 actuates operating wheel 7 whereby links 10 cause the linear sliding of pins 11 in slots 12. The extent of the linear movement is limited by the length of the toothed section 7′ of wheel 7.

When the locking arrangement is in the extended, or locking position of the bolts 13, shown in FIG. 1, the movement of links 10 has passed their dead-center position so that when pressure is applied in an inward direction on bolts 13, the links will tend to move wheel 7 further and no turning of the wheel in opposite direction, i.e., unlocking of bolts 13, is possible.

It can be seen from the above description that the locking arrangement here described is of extremely simple construction and of simple mechanical operation having few parts, most of which can be manufactured by stamping and do not require machining. The lock is strong enough to overcome difficulties caused by warping of the door, because owing to the gear ratio and the leverage of the lock, the power exerted is magnified on the bolts.

I claim:

1. A locking arrangement for doors and the like,
said arrangement comprising a door and jamb arrangement,
at least one elongated bolt adapted for springless extension and retraction,
said door being locked when said locking bolt is extended into said jamb and unlocked when said bolt is retracted,
key operated locking means for operation by a key,
a pair of spaced apart parallel plates,
each of said plates being attached to and being substantially normal to the longitudinal axis of said locking means,
pinion gear means mounted between said parallel plates for rotational movement responsive to the operation of said locking means,
an operating gear wheel being pivotally mounted between said parallel plates positioned to mesh with said pinion gear means to rotate responsive to the rotation of said pinion gear means,
link means having one end pivotally attached to a fixed point on said operating gear wheel and removed from the center thereof,
slot means in one of said pair of parallel plates,
said slot means being radial relative to the center of said operating gear wheel and starting at a point on said one of said pair of parallel plates that is adjacent a point on the operating gear wheel between the center of the wheel and the outer circumference of the wheel and extending toward the outer circumference, and pin means extending through said radially extending slot for pivotally attaching a fixed point on said at least one elongated locking bolt external to said pair of parallel plates to a fixed point on the other end of said link means for translating the rotational movement of said operating gear wheel into a linear movement of said one of said locking bolts for the extension and retraction thereof responsive to the rotation of said operating gear wheel.

2. The locking arrangement of claim 1 wherein four locking bolts are actuated each by a separate one of said links, each bolt being substantially 90° from any of the other bolts, said one end of each of said links that is pivotally attached to said operating gear wheel being at a point slightly counter-clockwise of a line passing through the center of the operating gear wheel and normal to the slot containing the pin attached to the other end of said one of each of said links, when each of said links are in the retracted position, and wherein said operating gear wheel rotates clockwise for unlocking the locking arrangement, and each of said links being shaped so as not to interfere with each other.

3. The locking arrangement of claim 1 wherein said key operated locking mechanism extends at the longitudinal axis thereof to both sides of the door for operation by the key at either side of the doors.

4. The locking arrangement of claim 1 wherein said slot means on said one of said pair of parallel plates extends to a point beyond the outer circumference of the operating gear wheel.

5. The locking arrangement of claim 1 wherein said slot is further from the center of said operating wheel than the point of pivotally attaching said arcuate link means to said operating gear wheel.

6. The locking arrangement of claim 5 wherein each of said link means are diametrically attached around the center of the operating wheel, and wherein in the retracted position the other end of the link means is slightly more than 90° counter-clockwise of the one end of the link means pivotally attached to the operating gear wheel where the operating gear wheel is rotated clockwise for unlocking the locking arragement.

7. The locking arrangement of claim 6 wherein in the extended position the other end of the link means is slightly clockwise of the end of the link means attached to the operating gear wheel.

* * * * *